US010611183B2

(12) United States Patent
Ohuchiyama et al.

(10) Patent No.: US 10,611,183 B2
(45) Date of Patent: Apr. 7, 2020

(54) SADDLE-STITCH BOOK BINDING SYSTEM

(71) Applicant: Horizon International Inc., Shiga (JP)

(72) Inventors: Kou Ohuchiyama, Shiga (JP); Takakazu Hori, Shiga (JP); Masayuki Kashiba, Shiga (JP); Hiroki Yamamoto, Shiga (JP)

(73) Assignee: Horizon International Inc., Shiga (JP)

( * ) Notice: Subject to any disclaimer, the term of this patent is extended or adjusted under 35 U.S.C. 154(b) by 0 days.

(21) Appl. No.: 15/775,852

(22) PCT Filed: Jun. 30, 2017

(86) PCT No.: PCT/JP2017/024182

§ 371 (c)(1),
(2) Date: May 14, 2018

(87) PCT Pub. No.: WO2018/034068

PCT Pub. Date: Feb. 22, 2018

(65) Prior Publication Data

US 2019/0193450 A1 Jun. 27, 2019

(30) Foreign Application Priority Data

Aug. 17, 2016 (JP) ..... 2016-159823

(51) Int. Cl.
*B42C 1/12* (2006.01)
*B42B 4/00* (2006.01)
(Continued)

(52) U.S. Cl.
CPC ..... *B42C 1/12* (2013.01); *B42B 4/00* (2013.01); *B42C 1/10* (2013.01); *B42C 19/00* (2013.01);
(Continued)

(58) Field of Classification Search
CPC .. B42C 1/10; B42C 1/12; B42C 19/00; B42C 19/08; B42B 4/00; B65H 37/04; B65H 39/11; B65H 45/12; B65H 2701/13212
(Continued)

(56) References Cited

U.S. PATENT DOCUMENTS 4,145,037 A * 3/1979 Mol ..... B65H 3/446 270/58.18
4,248,525 A * 2/1981 Sterrett ..... B65H 39/05 270/58.18
(Continued)

FOREIGN PATENT DOCUMENTS

| | | |
|---|---|---|
| JP | H10-114441 | 5/1998 |
| JP | H10-245150 | 9/1998 |
| JP | 2009-279799 | 5/2008 |

OTHER PUBLICATIONS

International search report dated Aug. 9, 2017 mailed in corresponding international application No. PCT/JP2017/024182.

*Primary Examiner* — Leslie A Nicholson, III
(74) *Attorney, Agent, or Firm* — Kirschstein, Israel, Schiffmiller & Pieroni, P.C.

(57) ABSTRACT

This system is provided with: a conveying device 1 that conveys paper P along a conveying path F; a sheet paper supply device 2, paper-folding device, or cutter connected to an upstream end of the conveying path; a gathering device 3 disposed midway through the conveying path; a saddle stitch device 7 connected to a downstream end of the conveying path; and a management unit 13 that collectively controls the conveying device, the sheet paper supply device, the paper-folding device, the cutter, the gathering device, and the saddle stitch device. The gathering device can switch operation between a non-operating mode, a first
(Continued)

operating mode for operating as a primary gathering device, and a second operating mode for operating as a paper insertion device.

1 Claim, 2 Drawing Sheets

(51) Int. Cl.

| | |
|---|---|
| ***B65H 37/04*** | (2006.01) |
| ***B42C 1/10*** | (2006.01) |
| ***B65H 39/11*** | (2006.01) |
| ***B42C 19/00*** | (2006.01) |
| ***B42C 19/08*** | (2006.01) |
| ***B65H 45/12*** | (2006.01) |

(52) U.S. Cl.
CPC ..... *B42C 19/08* (2013.01); *B65H 37/04* (2013.01); *B65H 39/11* (2013.01); *B65H 45/12* (2013.01); *B65H 2701/13212* (2013.01)

(58) Field of Classification Search
USPC ..... 270/52.18, 52.26, 52.27, 52.16, 58.18, 270/58.23, 58.29
See application file for complete search history.

(56) References Cited

U.S. PATENT DOCUMENTS 5,564,685 A * 10/1996 Reist ..... B42C 9/0006 270/52.18
5,657,978 A * 8/1997 Meier ..... B42C 19/08 270/52.16
6,332,605 B1 * 12/2001 Johansson ..... B65H 29/16 270/52.16
6,908,078 B2 * 6/2005 Suzuki ..... B42C 1/10 270/15
6,994,337 B1 * 2/2006 Cracknell ..... B26D 1/08 270/52.26
7,261,507 B2 * 8/2007 Horii ..... B42B 4/00 412/33
7,380,779 B2 * 6/2008 Nakamura ..... B65H 5/26 270/58.01
7,451,970 B2 * 11/2008 Kawata ..... B42C 19/08 270/58.14
7,926,798 B2 * 4/2011 Taketsugu ..... B42D 1/007 270/32
8,006,970 B2 * 8/2011 Sauer ..... B65H 33/16 270/52.09
8,042,808 B2 * 10/2011 Sato ..... G03G 15/6555 270/52.14
8,596,632 B2 * 12/2013 Silberbauer ..... B42C 1/10 270/52.14

* cited by examiner

SADDLE-STITCH BOOK BINDING SYSTEM

TECHNICAL FIELD

The present invention relates to a saddle-stitch book binding system.

BACKGROUND ART

Conventional saddle-stitch book binding systems have different configurations depending on the type of printing method (offset printing, cut paper digital printing and roll paper digital printing, etc.) applied to printed matter to be bound. More specifically, in the offset printing, the saddle-stitch book binding system is basically in the form of a combination of a collator and a saddle stitching device, or a combination of a folding device and a saddle stitching device, and as required, a cover supplying device and/or an accumulating device are(is) incorporated into the system (for example, Patent Document 1).

In the cut paper digital printing, the saddle-stitch book binding system is basically in the form of a combination of a cut paper supplying device and a saddle stitching device, or a combination of a folding device and a saddle stitching device, and as required, a cover supplying device and/or an accumulating device are(is) incorporated into the system (for example, Patent Document 2). In the roll paper digital printing, the saddle-stitch book binding system is basically in the form of a combination of a cutter and a saddle stitching device, and as required, a cover supplying device and/or an accumulating device are(is) incorporated into the system (for example, Patent Document 3).

In order to be able to handle all of different kinds of printed material which differ from one another in the printing method, it is necessary to provide a dedicated saddle-stitch book binding system for each printing method, which leads to a problem such as high cost and occupation of a large space.

PRIOR ART DOCUMENTS

Patent Documents

Patent Document 1: JP 2009-279799 A
Patent Document 2: JP H10-245150 A
Patent Document 3: JP H10-114441 A

SUMMARY OF THE INVENTION

Problems to be Solved by the Invention

It is, therefore, an object of the present invention to provide a saddle-stitch book binding system capable of handling different kinds of printed material which differ from one another in the printing method.

Means for Solving the Problems

In order to solve the object, the present invention provides a saddle-stitch book binding system comprising: a conveying device conveying sheets along a conveying path; a cut paper supply device or a folding device or a cutter connected to an upstream end of the conveying path; a collator arranged on the intermediate portion of the conveying path; a saddle stitching device connected to a downstream end of the conveying path; and a controller integrally controlling the cut paper supplying device and the folding device and the cutter and the collator and the saddle stitching device, wherein the collator can switch between a non-operating mode, a first operating mode in which the collator operates as such collator and a second operating mode in which the collator operates as an additional sheet supplying device. In this case, it should be noted that the technical term "additional sheet supplying device" means a device for adding another sheet of paper (or other sheets of paper) to one or more sheets of paper conveyed on the conveying path from the upstream end of the conveying path, and a cover supplying device is also included in the additional sheet supplying device (the same applies hereinafter).

In the above configuration, when the saddle-stitching device is not provided with an accumulating section, an accumulating device is arranged upstream or downstream of the collator on the conveying path.

Effect of the Invention

According to the present invention, when the collator operates in the non-operating mode, the saddle-stitch book binding system can be employed in the form of a combination of the cut paper supplying device or the folding device or the cutter, and the saddle stitching device. Also when the collator operates in the first operating mode, the saddle-stitch book binding system can be employed in the form of a combination of the collator and the saddle stitching device by stopping the operation of the device connected to the upstream end of the conveying path. Also when the collator operates in the second operating mode, the saddle-stitch book binding system can be employed in the form of a combination of the cut paper supplying device or the folding device or the cutter, and the additional sheet supplying device (collator), and the saddle stitching device.

Thus it is possible to handle different kinds of printed material which differ from one another in the printing method by means of a single saddle-stitch book binding system, and thereby users don't have to provide a dedicated saddle-stitch book binding system for each printing method so that the manufacturing cost and installation space are reduced considerably. Furthermore, the collator can be used as not only such collator but also the additional sheet supplying device, it is not necessary to incorporate a dedicated additional sheet supplying device into the system.

BEST MODE FOR CARRYING OUT THE INVENTION

Figure 1:
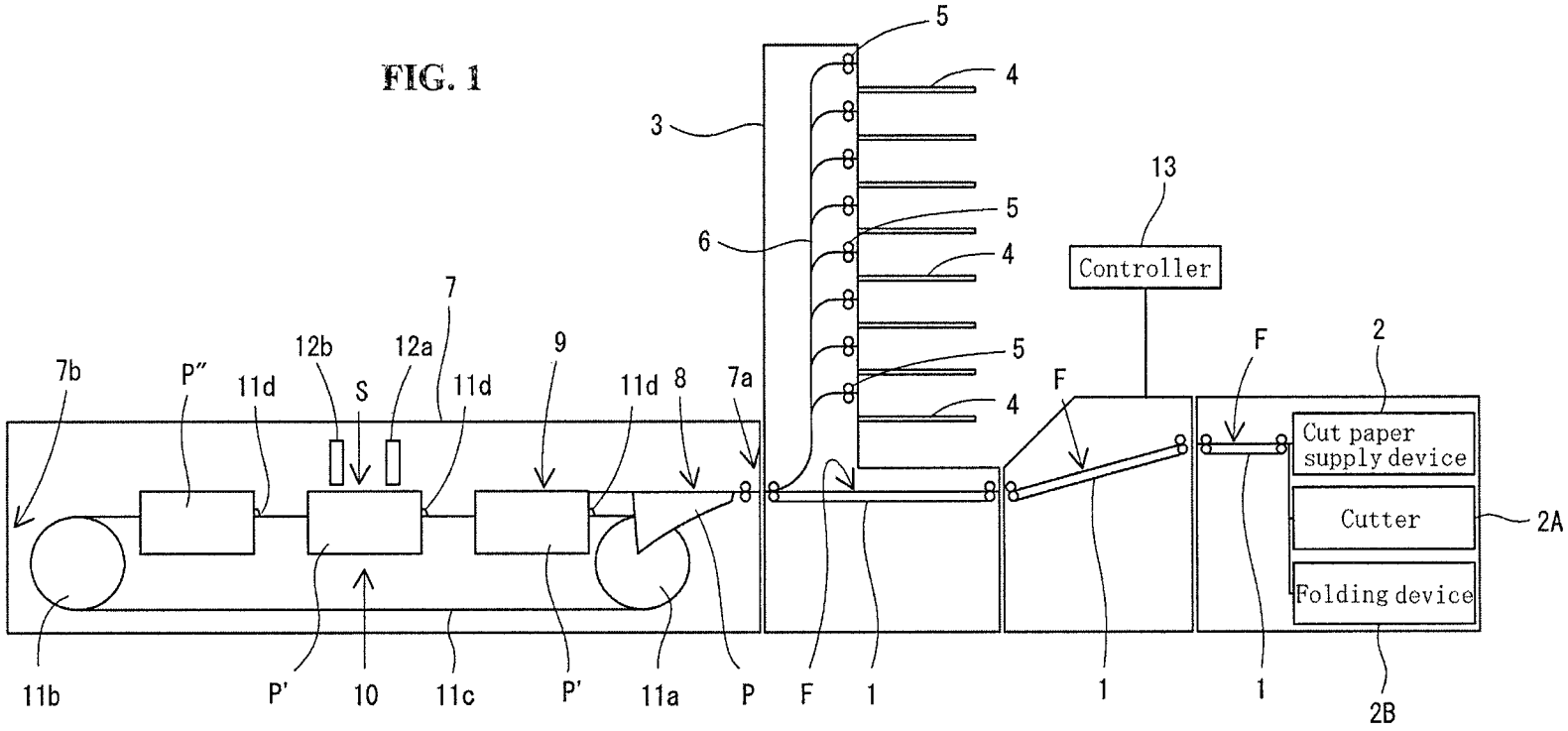
FIG. 1 is a front view schematically illustrating a configuration of a saddle-stitch book binding system according to an embodiment of the present invention.

A preferred embodiment of the present invention will be explained below with reference to accompanying drawings. FIG. 1 is a block diagram schematically illustrating a configuration of a saddle-stitch book binding system according to the present invention. Referring to FIG. 1, according to the present invention, a conveying device 1 is arranged for conveying sheets of paper along a conveying path F. The conveying device 1 has an appropriate well-known configuration (comprising, for example, a combination of a plurality of conveyer belts, or a combination of a plurality of feed roller pairs, or a combination of one or more conveyer belts and one or more feed roller pairs, etc.).

A cut paper supplying device 2 or a folding device 2B or a cutter 2A is connected to an upstream end of the conveying path F. In this case, the cut paper supplying device 2 and the folding device 2B and the cutter 2A are chosen depending on an aspect of printing of printed material to be bound (the aspect of printing differs for each printing method). In the embodiment shown in FIG. 1, in order to be able to handle both of printed material formed by the cut paper digital printing and printed material formed by the offset printing, the cut paper supplying device 2 is connected to the upstream end of the conveying path F. The cut paper supplying device 2 has an appropriate well-known configuration.

A collator 3 is arranged on the intermediate portion of the conveying path F. The collator 3 is a well-known vertical collator. In the embodiment shown in FIG. 1, the collator 3 comprises a plurality of shelves 4 arranged in a vertical direction to leave spaces therebetween, a sheet ejector 5 arranged at an exit of each of the shelves 4, a vertical sheet conveying path 6 arranged opposite to the exits of the shelves 4, and a conveying mechanism (not shown) sequentially conveying sheets of paper discharged from the respective shelves 4 downwardly along the sheet conveying path 6.

The collator 3 can switch between a non-operating mode, a first operating mode in which the collator 3 operates as such collator and a second operating mode in which the collator 3 operates as an additional sheet supplying device. The additional sheet supplying device is a device for adding another sheet of paper (or other sheets of paper) to one or more sheets of paper conveyed on the conveying path F from the upstream end of the conveying path F.

A saddle stitching device 7 is connected to a downstream end of the conveying path F. In the embodiment shown in FIG. 1, the saddle stitching device 7 comprises an entrance 7*a* and a folding section 8 arranged downstream of the entrance 7*a*. The folding section 8 folds a sheet of paper P fed from the entrance 7*a* in half along a predetermined fold in a manner such that the sheet of paper P becomes saddle-shaped.

The saddle stitching device further comprises an accumulating section 9 arranged downstream of the folding section 8 to accumulate the folded sheets of paper P into a sheet bundle P' which forms a book block, a stitching section 10 arranged downstream of the accumulating section 9, an exit 7*b*, and a conveying mechanism 11 extending between the accumulating section 9 and the exit 7*b* so as to convey the sheet bundle P' while keeping an attitude of the sheet bundle P' inverted V-shaped. The stitching section 10 comprises a pair of stitchers 12*a*, 12*b* arranged at a stitching position S on a conveying path of the conveying mechanism 11 to bind the sheet bundle P' with wire.

The conveying mechanism 11 comprises a pair of pulleys 11*a*, 11*b* mounted on a horizontal rotating axis extending at a right angle to a conveying direction on the accumulating section 9 side and a horizontal rotating axis extending at a right angle to the conveying direction on the exit 7*b* side, respectively, and an endless belt 11*c* extending between the pair of pulleys 11*a*, 11*b*, and a drive mechanism (not shown) rotating the rotating axis of the pulley 11*a*. A plurality of feed projections 11*d* are fixed to the endless belt 11*c* while being arranged along the endless belt 11*c* at even intervals.

Thus during rotation of the endless belt 11*c*, whenever the sheet bundle P' is formed in the accumulating section 9, the nearest feed projection 11*d* collides with a tail end of the sheet bundle P' so that the sheet bundle P' is conveyed by the endless belt 11*c* to the stitching position S while keeping the inverted V-shaped attitude thereof.

When the sheet bundle P' arrives at the stitching position, the endless belt 11*c* temporarily stops. During this temporary halt of the endless belt 11*c*, the sheet bundle P' is bound by the stitchers 12*a*, 12*b* so as to become a product P". Thereafter the endless belt 11*c* starts rotating so that a conveyance of the product P" to the exit 7*b* is performed in conjunction with a conveyance of the next sheet bundle P' from the accumulating section 9 to the stitching position S by means of the feed projections 11*d*.

In the above embodiment, although the saddle stitching device 7 comprises the accumulating section 9, according to another embodiment, an accumulating device may be arranged upstream or downstream of the collator on the conveying path without the accumulating section of the saddle stitching device.

Furthermore, according to the present invention, the saddle-stitch book binding system comprises a controller 13 operatively connected to the conveying device 1, the cut paper supplying device 2, the collator 3 and the saddle stitching device 7 to integrally control these devices 1-3 and 7. The controller 13 displays system configurations of the saddle-stitch book binding system which correspond to the cases of operating the collator 3 in the non-operating mode, the first operating mode and the second operating mode, respectively.

In the embodiment shown in FIG. 1, the following three system configurations are displayed by the controller 13.

(1) A first system configuration (when the collator 3 operates in the non-operating mode)

The cut paper supplying device 2+the saddle stitching device 7

(2) A second system configuration (when the collator 3 operates in the first operating mode)

The collator 3+the saddle stitching device 7 (in this case, the cut paper supplying device is stopped)

(3) A third system configuration (when the collator 3 operates in the second operating mode)

The cut paper supplying device 2+the collator 3 (operating as the additional sheet supplying device)+the saddle stitching device 7

Thus before an operation of the saddle-stitch book binding system starts, the controller 13 receives from a user an input of a choice among the three system configurations, and performs an initial setting of the saddle-stitch book binding system according to this input and starts the operation of the system.

In this case, the first and second system configurations is the same as those of saddle-stitch book binding systems well-known in the prior art, and therefore, the controller 13 controls the system in a conventional manner.

On the other hand, in the third system configuration, the collator 3 operates as the additional sheet supplying device synchronously with the cut paper supplying device 2. Therefore the synchronous control of the cut paper supplying device 2 and collator 3 by the controller 13 when the third system configuration is chosen will be explained below.

Figure 2:
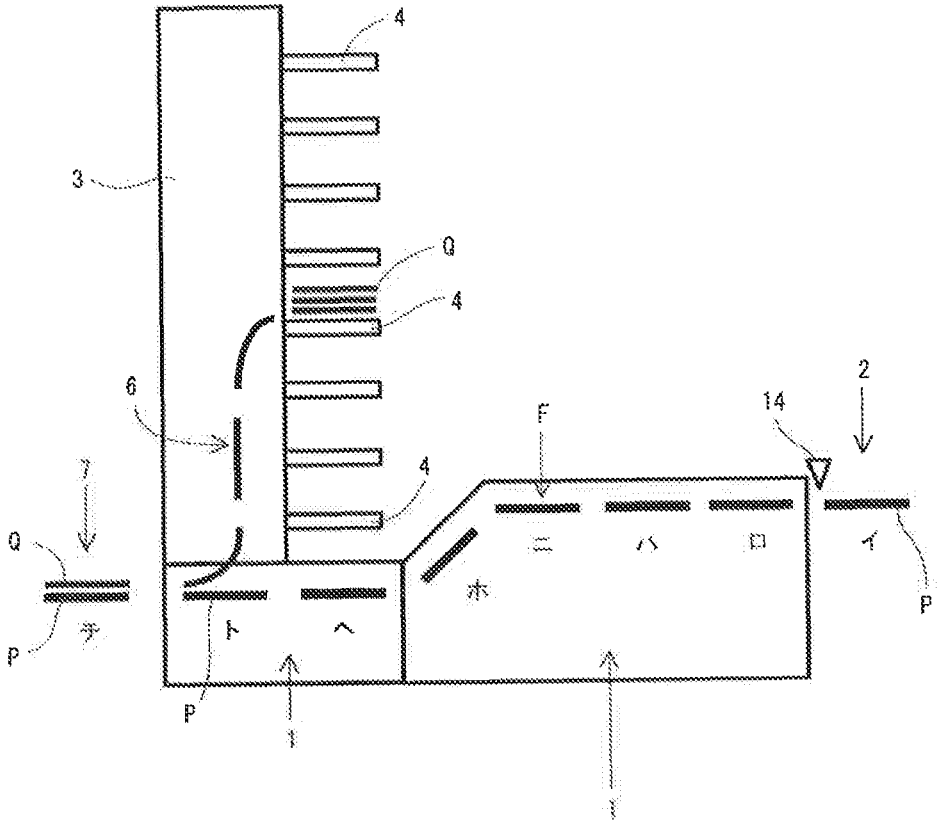
FIG. 2 is a front view illustrating a synchronous control method for a collator and a sheet supplying device when the collator of the saddle-stitch book binding system shown in FIG. 1 operates in a second operating mode.

FIG. 2 is a front view illustrating this synchronous control method. Referring to FIG. 2, in this embodiment, another (type of) sheet of paper (referred to as "additional sheet" hereinafter) Q is supplied from the collator 3 in the sheet of paper P conveyed on the conveying path F from the upstream end of the conveying path F, and the additional sheets Q are stacked on one shelf 4 of the collator 3. Further a conveying speed of the conveying device 1 (a travelling speed of the sheet of paper P on the conveying path F) and a conveying speed of the collator 3 (a travelling speed of the additional sheet Q on the sheet conveying path 6) are set to be the same.

Then when it is confirmed by the controller 13 that the sheet of paper P is supplied on the conveying path F based on a detection signal of a sheet detector 14 which is arranged at the upstream end of the conveying path F or a sheet detection signal from the cut paper supplying device 2, in the controller 13, a default value of a timer or a pulse counter is set to correspond to a predetermined timing and thereafter, when the set value is subtracted until the set value becomes zero, the supply of the additional sheet Q from the collator 3 starts.

This timing of the supply of the additional sheet Q is calculated in the following manner.

(a) In the case of using the timer

[(A distance along the conveying path F from an input end of the conveying path F to a position of supply of the additional sheet Q−A distance along the sheet conveying path 6 from a position of the shelf 4 with the stack of additional sheets Q to the position of supply of the additional sheet Q)/A speed of conveying]+Correction time (b) In the case of using the pulse counter

[(A distance along the conveying path F from the input end of the conveying path F to a position of supply of the additional sheet Q−A distance along the sheet conveying path 6 from a position of the shelf 4 with the stack of additional sheets Q to the position of supply of the additional sheet Q)/A length of conveyance per one pulse]+Correction time In this case, the correction time is appropriately determined depending on the pattern of supplying the additional sheet Q by the collator 3.

That is to say, in this embodiment, the collator 3 can add the additional sheet Q to the sheet(s) of paper conveyed on the conveying path F in the following different three patterns.

(1) A pattern of supplying the additional sheet Q onto the last sheet of paper P of the sheet bundle P' and conveying the sheet bundle P' together with the additional sheet Q to the accumulating section 9 of the saddle stitching device 7. In this case, when the last sheet of paper P arrives at a position "ニ (katakana character)" on the conveying path F, the supply of the additional sheet Q starts.

(2) A pattern of supplying the additional sheet Q behind of the last sheet of paper P of the sheet bundle P' on the conveying path F and placing the additional sheet Q on the last sheet of paper P at the accumulating section 9 of the saddle stitching device 7. In this case, when the last sheet of paper P arrives at a position "ハ (katakana character)" on the conveying path F, the supply of the additional sheet Q starts.

(3) A pattern of supplying the additional sheet Q ahead of the head sheet P of the sheet bundle P' on the conveying path F and inserting the additional sheet Q under the head sheet of paper P at the accumulating section 9 of the saddle stitching device 7. In this case, when the head sheet of paper P arrives at a position "ロ (katakana character)" on the conveying path F, the supply of the additional sheet Q starts.

The correction time is determined for each pattern of supplying the additional sheet Q as follows.

(i) For the pattern (1)

The correction time is zero.

(ii) For the pattern (2)

The correction time is added to the timing of the supply of the additional sheet Q.

(iii) for the pattern (3)

The correction time is subtracted from the timing of the supply of the additional sheet Q.

Although in the embodiment shown in FIG. 2, only one (a single type of) additional sheet Q is supplied from the collator 3, it is also possible to supply a plurality of (different types of) additional sheets Q as a sheet bundle from the collator in the same three supplying patterns as described above by using plural shelves 4 of the collator 3.

As described above, in the saddle-stitch book binding system of the present invention, when the collator operates in the non-operating mode, the saddle-stitch book binding system can be employed in the form of a combination of the cut paper supplying device or the folding device or the cutter, and the saddle stitching device. Also when the collator operates in the first operating mode, the saddle-stitch book binding system can be employed in the form of a combination of the collator and the saddle stitching device by stopping the operation of the device connected to the upstream end of the conveying path. Also when the collator operates in the second operating mode, the saddle-stitch book binding system can be employed in the form of a combination of the cut paper supplying device or the folding device or the cutter, and the additional sheet supplying device (collator), and the saddle stitching device. Thus it is possible to handle different kinds of printed material which differ from one another in the printing method by means of a single saddle-stitch book binding system.

Thereby, users don't have to provide a dedicated saddle-stitch book binding system for each printing method so that the manufacturing cost and installation space are reduced considerably. In addition, because the collator can be used as not only such collator but also the additional sheet supplying device, it is not necessary to incorporate a dedicated additional sheet supplying device into the system.

DESCRIPTION OF REFERENCE NUMERALS

1 Conveying device
2 Cut paper supplying device
3 Collator
4 Shelf
5 Sheet ejector
6 Sheet conveying path
7 Saddle stitching device
7*a* Entrance
7*b* Exit
8 Folding section
9 Accumulating section
10 Stitching section
11 Conveying mechanism
11*a*, 11*b* Pulley
11*c* Endless belt
11*d* Feed projection
12*a*, 12*b* Stitcher
13 Controller
14 Sheet sensor
F Conveying path
P Sheet of paper
P' Sheet bundle
P" Product
Q Additional sheet
S Stitching position

The invention claimed is:

1. A saddle-stitch book binding system, comprising:

a conveying device for conveying sheets of paper along a conveying path;

a cut paper supply device, or a folding device, or a cutter, connected to an upstream end of the conveying path;

a collator arranged on an intermediate portion of the conveying path;

a saddle stitching device connected to a downstream end of the conveying path; and a controller for integrally controlling the cut paper supply device, or the folding device, or the cutter, and the conveying device, the collator, and the saddle stitching device, wherein the collator is switchable between a non-operating mode, a first operating mode in which the collator operates as a collator, and a second operating mode in which the collator operates as an additional sheet supplying device, and wherein the cut paper supply device, or the folding device, or the cutter, that is connected to the upstream end of the conveying path, is stopped when the collator is operating in the first operating mode.

* * * * *